US010392850B2

(12) United States Patent
Kodandaram et al.

(10) Patent No.: US 10,392,850 B2
(45) Date of Patent: Aug. 27, 2019

(54) WINDOW ASSEMBLY AND A VEHICLE

(71) Applicant: GM GLOBAL TECHNOLOGY OPERATIONS LLC, Detroit, MI (US)

(72) Inventors: Priyank Kodandaram, Ann Arbor, MI (US); Terrence P. Costigan, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 250 days.

(21) Appl. No.: 15/481,857

(22) Filed: Apr. 7, 2017

(65) Prior Publication Data

US 2018/0290521 A1 Oct. 11, 2018

(51) Int. Cl.

| | |
|---|---|
| ***E05F 11/44*** | (2006.01) |
| ***E05F 11/38*** | (2006.01) |
| *E05F 15/689* | (2015.01) |

(52) U.S. Cl.

CPC ..... *E05F 11/382* (2013.01); *E05F 11/445* (2013.01); *E05F 15/689* (2015.01); *E05Y 2201/22* (2013.01); *E05Y 2201/604* (2013.01); *E05Y 2201/626* (2013.01); *E05Y 2800/72* (2013.01); *E05Y 2900/55* (2013.01)

(58) Field of Classification Search

CPC .... B60J 1/14; B60J 1/1853; B60J 3/04; E05F 11/382; E05Y 2900/55

USPC ..... 49/348, 350, 351, 353

See application file for complete search history.

(56) References Cited

U.S. PATENT DOCUMENTS

| | | | | | |
|---|---|---|---|---|---|
| 1,942,962 | A * | 1/1934 | Hart | E05F 11/382 | 192/15 |
| 2,287,269 | A * | 6/1942 | Parsons | E05F 11/445 | 74/110 |
| 2,379,922 | A * | 7/1945 | Roethel | E05F 11/382 | 49/375 |
| 2,551,545 | A * | 5/1951 | Parsons | B60J 1/14 | 49/335 |
| 2,560,976 | A * | 7/1951 | Parsons | E05F 11/445 | 49/349 |
| 2,624,570 | A * | 1/1953 | Dennis | B60J 1/14 | 49/338 |
| 2,658,792 | A * | 11/1953 | Scott | B60J 5/06 | 244/129.5 |
| 2,788,966 | A * | 4/1957 | Leichsenring | E05B 77/00 | 292/164 |
| 2,876,003 | A * | 3/1959 | Probst | E05F 11/445 | 49/227 |

(Continued)

*Primary Examiner* — Brent W Herring

(74) *Attorney, Agent, or Firm* — Quinn IP Law

(57) ABSTRACT

A vehicle and a window assembly include a window movable between a closed and open position. The assembly includes an arm movable between a first and second position. The window is disposed in the closed position when the arm is in the first position and the window disposed in the open position when the arm is in the second position. The arm includes an extension fixed thereto such that the arm and the extension both move concurrently about a first pivot point. The assembly includes a connector coupled to the extension at a second pivot point. The arm is coupled to the window through the connector. The first and second pivot points are spaced from each other. The connector is coupled to the window such that movement of the arm moves the connector about the second pivot point which causes the window to move between the closed and open positions.

20 Claims, 2 Drawing Sheets

(56) References Cited

U.S. PATENT DOCUMENTS

| | | | | | | |
|---|---|---|---|---|---|---|
| 2,998,246 | A | * | 8/1961 | Probst | E05F 11/445 | 49/227 |
| 3,020,040 | A | * | 2/1962 | King | E05F 11/445 | 49/227 |
| 3,373,528 | A | * | 3/1968 | Tinder | E05F 11/445 | 310/83 |
| 3,646,707 | A | * | 3/1972 | Lystad | E05F 11/382 | 49/227 |
| 3,659,381 | A | * | 5/1972 | Frey | E05F 11/382 | 49/103 |
| 3,702,041 | A | * | 11/1972 | Podolan | E05F 11/426 | 49/227 |
| 3,900,965 | A | * | 8/1975 | Mummert | E05F 11/382 | 49/103 |
| 4,094,100 | A | * | 6/1978 | Fukumoto | B60J 1/17 | 49/348 |
| 4,550,529 | A | * | 11/1985 | Drouillard | B60J 1/17 | 49/348 |
| 4,586,290 | A | * | 5/1986 | Juechter | E05F 11/385 | 49/348 |
| 4,986,029 | A | * | 1/1991 | Richter | E05F 11/445 | 49/349 |
| 5,255,470 | A | * | 10/1993 | Dupuy | E05F 11/445 | 49/227 |
| 5,850,711 | A | * | 12/1998 | Takahashi | B60J 1/17 | 49/351 |
| 5,910,077 | A | * | 6/1999 | Aumiller | B60N 3/023 | 49/460 |

* cited by examiner

WINDOW ASSEMBLY AND A VEHICLE

INTRODUCTION

Vehicles can have a passenger compartment and one or more doors to enter and exit the passenger compartment. The doors can each include a door window to provide visibility into and outside of the passenger compartment. Some vehicles can also include one or more vent windows which partially open as compared to the door window which can completely open. Furthermore, the door window generally moves linearly relative to the respective doors as compared to the vent windows which rotate relative to the respective door.

SUMMARY

The present disclosure provides a window assembly including a window movable between a closed position and an open position. The window assembly also includes an arm movable between a first position and a second position. The window is disposed in the closed position when the arm is in the first position and the window disposed in the open position when the arm is in the second position. The arm includes an extension fixed thereto such that the arm and the extension both move concurrently about a first pivot point. The window assembly further includes a connector coupled to the extension at a second pivot point. The arm is coupled to the window through the connector. The first and second pivot points are spaced from each other. The connector is coupled to the window such that movement of the arm moves the connector about the second pivot point which causes the window to move between the closed and open positions.

The present disclosure also provides a vehicle including a frame defining an aperture. The vehicle further includes a window supported by the frame. The window is movable linearly relative to the frame between a closed position covering the aperture and an open position partially uncovering the aperture. The vehicle also includes an arm supported by the frame at a first pivot point. The arm is movable relative to the frame between a first position and a second position. The window is disposed in the closed position when the arm is in the first position and the window disposed in the open position when the arm is in the second position. The arm includes an extension fixed thereto such that the arm and the extension both move concurrently about the first pivot point. The vehicle further includes a connector coupled to the extension at a second pivot point. The arm is coupled to the window through the connector. The first and second pivot points are spaced from each other. The connector is coupled to the window such that movement of the arm moves the connector about the second pivot point which causes the window to move between the closed and open positions.

The detailed description and the drawings or FIGS. are supportive and descriptive of the disclosure, but the claim scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Those having ordinary skill in the art will recognize that all directional references (e.g., above, below, upward, up, downward, down, top, bottom, left, right, vertical, horizontal, etc.) are used descriptively for the FIGS. to aid the reader's understanding, and do not represent limitations (for example, to the position, orientation, or use, etc.) on the scope of the disclosure, as defined by the appended claims.

Figure 1:
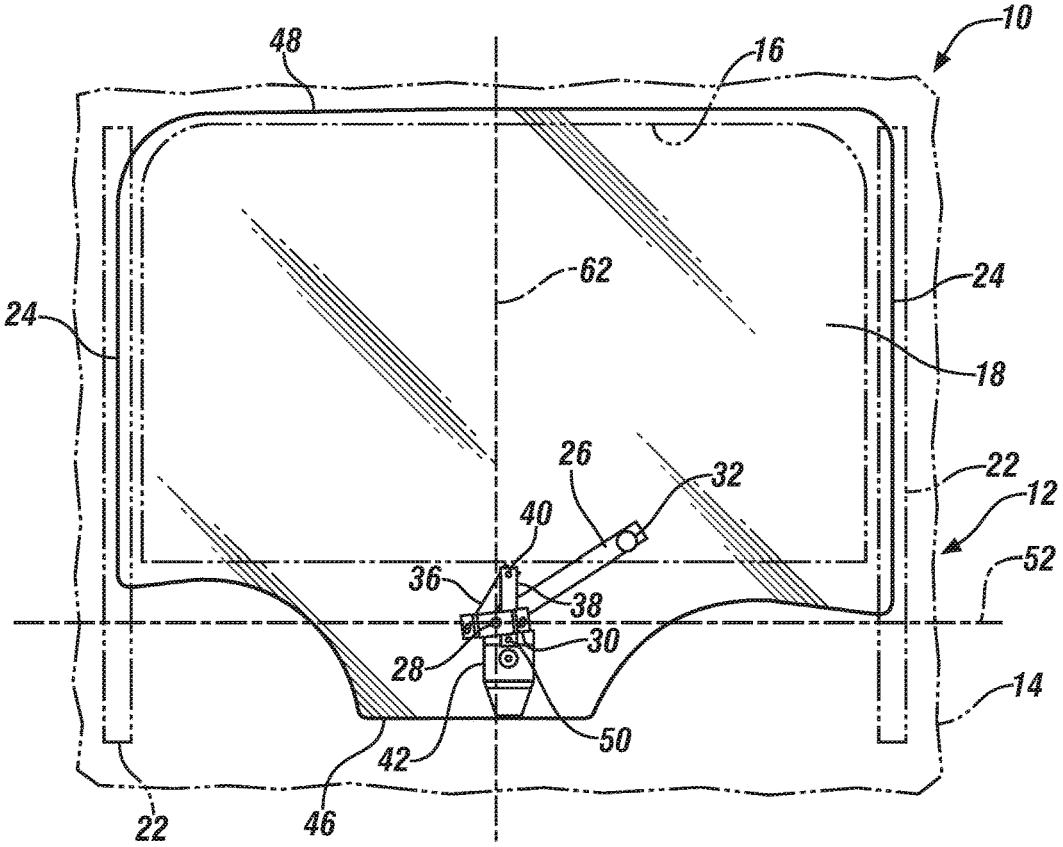
FIG. 1 is a schematic illustration of a window assembly.

Referring to the FIGS., wherein like numerals indicate like or corresponding parts throughout the several views, a vehicle 10 and a window assembly 12 are generally shown in FIG. 1.

The window assembly 12 can be utilized in a vehicle application or a non-vehicle application. Non-limiting examples of the vehicles 10 can include cars, trucks, boats, watercrafts, off-road vehicles, aircrafts, farm equipment or any other suitable movable platform. Non-limiting examples of the non-vehicles can include machines, farm equipment, houses, buildings, or any other suitable non-vehicle.

For the vehicle application, the vehicle 10 can include a passenger compartment. Generally, one or more occupants can be disposed in the passenger compartment. Furthermore, one of the occupants can steer the vehicle 10 from the passenger compartment.

The passenger compartment can have one or more doors that open and close to allow the occupants to enter and exit the vehicle 10. The doors can each include a door window which can provide visibility into and out of the passenger compartment. Furthermore, the door windows can be movable linearly relative to the respective doors to open and close the door windows. The door windows can move completely out of sight when opened such that the door windows are completely hidden inside the respective doors. The door windows can be movable electronically by pressing a button, etc., or can be movable manually by a handcrank. To electronically move the door windows, wire harnesses and motorized window regulators are utilized to open and close the respective door windows.

Referring to FIG. 1, the vehicle 10 can include a frame 14 defining an aperture 16. The frame 14 and the aperture 16 are shown in phantom lines in FIG. 1 to more clearly illustrate other features of the window assembly 12. In certain embodiments, the frame 14 is part of one of the doors. In other embodiments, the frame 14 is part of the passenger compartment. For example, in one embodiment, the frame 14 is a panel of the vehicle 10. In yet other embodiments, the frame 14 is part of the non-vehicle.

The window assembly 12 includes a window 18 movable between a closed position and an open position. In certain embodiments, the window 18 is movable linearly (see arrow 20 in FIG. 2) between the closed and open positions. Generally, the window 18 is supported by the frame 14 and movable linearly relative to the frame 14 between the closed position covering the aperture 16 and the open position partially uncovering the aperture 16. The window 18 can be partially out of sight when in the open position. As such, part of the window 18 is hidden inside the respective door or the frame 14, etc., when in the open position. The window 18 does not move to fully uncover the aperture 16 when in the open position. In other words, the window 18 does not move to be completely hidden from sight. Due to the partial uncovering of the aperture 16, the window 18 can be referred to as a vent window. For example, the vent window 18 can be disposed proximal to or near the respective door window. As another example, for a minivan type of vehicle, the window 18 can be disposed along the side of the vehicle proximal to or near the back of the vehicle.

As mentioned above, the window 18 can move up and down linearly relative to the frame 14. Whether in a vehicle application or non-vehicle application, the window 18 can provide visibility into and/or out of the structure, e.g., car, truck, aircraft, machine, building, etc., and/or fluid communication into and/or out of the structure, e.g., car, truck, aircraft, machine, building, etc. Furthermore, when the window 18 is in the open position, air can enter the structure. As one non-limiting example, when the window 18 is open, air can enter the passenger compartment.

The frame 14 can include one or more glass run-channels 22. The glass run-channels 22 are shown in phantom lines in FIG. 1 to more clearly illustrate other features of the window assembly 12. The glass run-channels 22 can be fixed to the frame 14. The window 18 can include opposing side edges 24, and at least part of the side edges 24 are disposed in respective glass run-channels 22. Therefore, the side edges 24 are spaced from each other.

The glass run-channels 22 guide the window 18 linearly during movement between the closed and open positions. The frame 14 and the glass run-channels 22 can be separate pieces fixed to each other, or the frame 14 and the glass run-channels 22 can be formed of one piece. If separate pieces, the frame 14 and the glass run-channels 22 can be fixed to each other by any suitable method(s), and non-limiting examples can include welding, adhesive, one or more fasteners, one or more pins, one or more studs, etc. If formed of one piece, the frame 14 and the glass run-channels 22 can be fixed to each other by any suitable method(s), and non-limiting examples can include extrusion, casting, stamping, etc.

Figure 2:
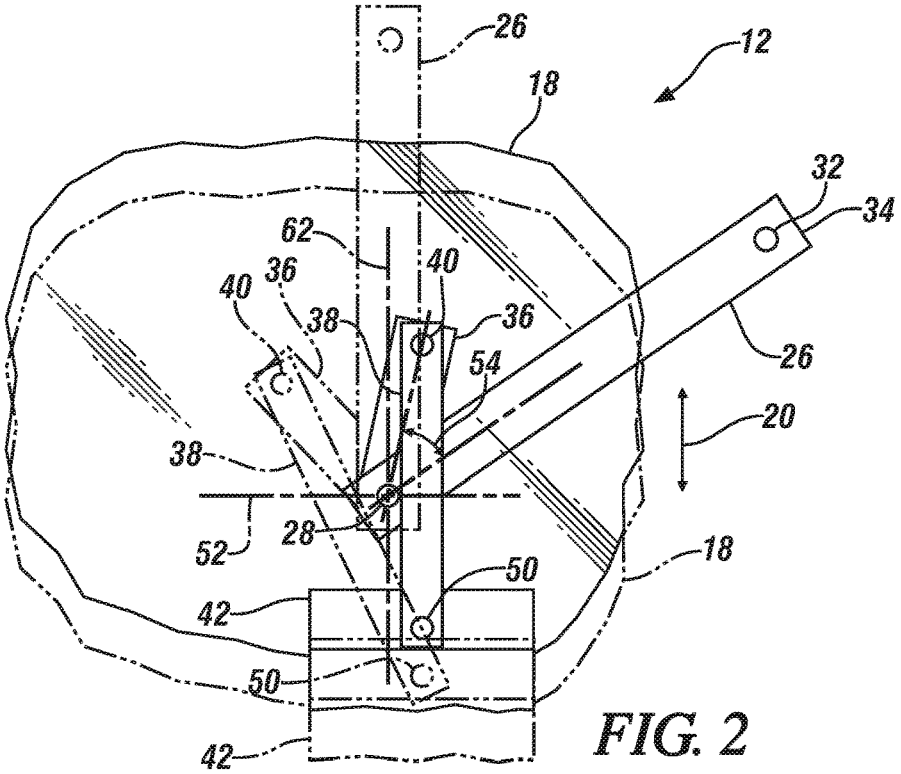
FIG. 2 is a schematic illustration view of an arm in a first position and a window in a closed position, which are illustrated in solid lines, and the arm in a second position and the window in an open position, which are illustrated in phantom lines.

Referring to FIG. 2, the window assembly 12 also includes an arm 26 movable between a first position and a second position. The window 18 is disposed in the closed position when the arm 26 is in the first position and the window 18 is disposed in the open position when the arm 26 is in the second position. Simply stated, the arm 26 provides a manual way to open and close the vent window 18. For illustrative purposes only, the first position is shown in solid lines in FIG. 2, and the second position is shown in phantom lines in FIG. 2. Therefore, when the arm 26 is in the second position, the window 18 is partially uncovering the aperture 16.

The arm 26 is supported by the frame 14 at a first pivot point 28. Specifically, the arm 26 is movable relative to the frame 14 between the first position which moves the window 18 to the closed position and the second position which moves the window 18 to the open position. More specifically, the arm 26 is movable relative to the first pivot point 28. The first pivot point 28 remains in a fixed position as the arm 26 moves between the first and second positions. In certain embodiments, the arm 26 is rotatable about the first pivot point 28. Therefore, as the arm 26 rotates about the first pivot point 28 relative to the frame 14, the window 18 moves linearly relative to the frame 14 independently of the arm 26. Since the window 18 moves to a maximum of partially uncovering the aperture 16 in the second position, the arm 26 can rotate less than one-complete revolution relative to the first pivot point 28 (compare the first and second positions of the arm 26 in FIG. 2).

Figure 3:
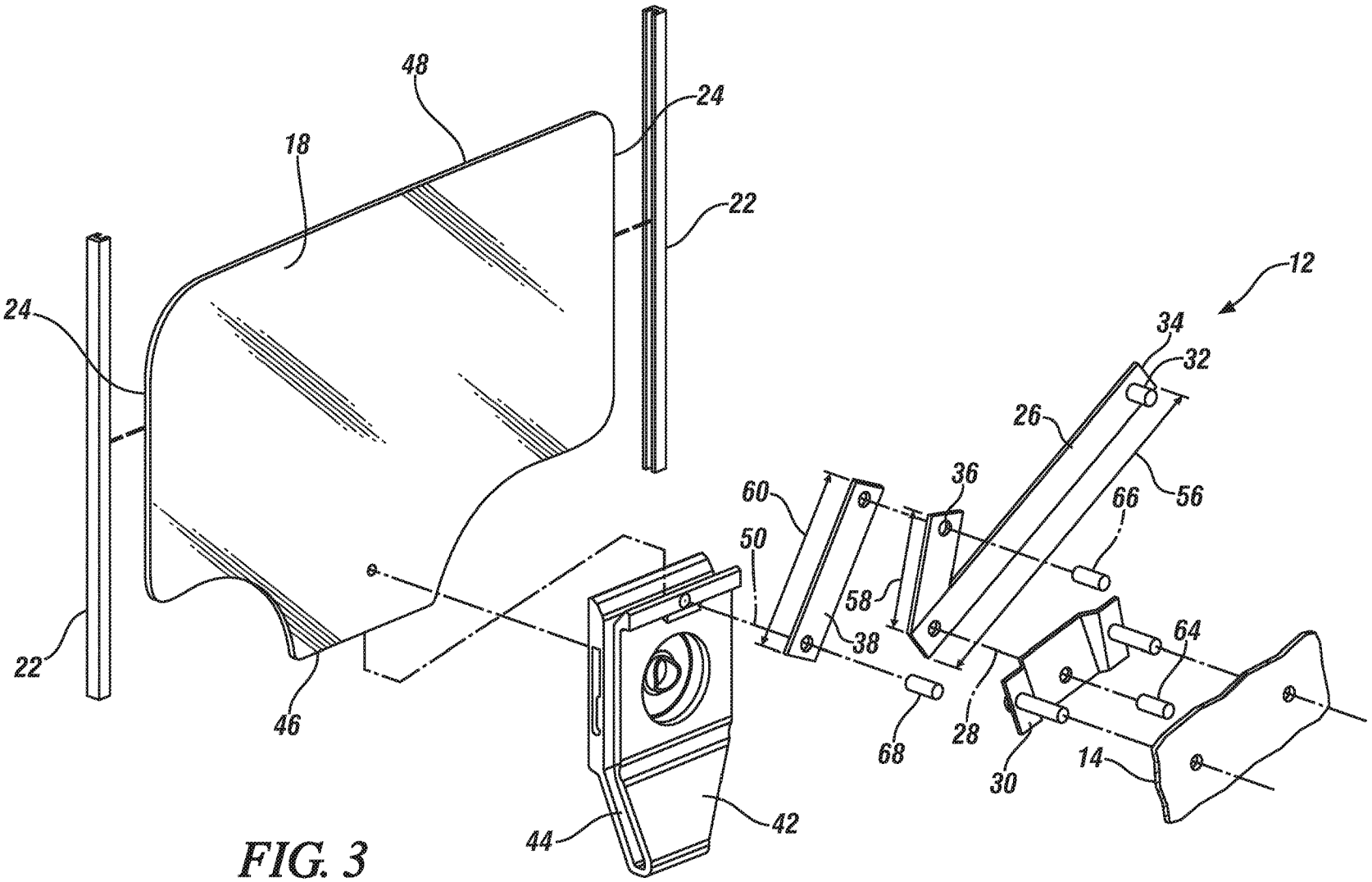
FIG. 3 is a schematic perspective exploded view of the window assembly, with a frame shown fragmented.

As best shown in FIG. 3, the window assembly 12 can include a brace 30 fixed to the frame 14 to maintain the position of the first pivot point 28. Therefore, the first pivot point 28 remains in the fixed position due to the brace 30 being fixed to the frame 14. As such, the location of the first pivot point 28 remains constant.

The arm 26 is supported by and movable relative to the brace 30. The brace 30 has been eliminated in FIG. 2 to more clearly illustrate other features of the window assembly 12. The frame 14 and the brace 30 can be separate pieces fixed to each other, or the frame 14 and the brace 30 can be formed of one piece. If separate pieces, the frame 14 and the brace 30 can be fixed to each other by any suitable method(s), and non-limiting examples can include welding, adhesive, one or more fasteners, one or more pins, one or more studs, etc. If formed of one piece, the frame 14 and the brace 30 can be fixed to each other by any suitable method(s), and non-limiting examples can include extrusion, casting, stamping, etc.

The arm 26 can be any suitable configuration. In certain embodiments, the arm 26 is a handle. Therefore, a user can grasp/move the arm 26/handle which correspondingly causes the window 18 to open or close. For example, in the vehicle application, one of the occupants of the vehicle 10 can move the arm 26/handle to open and close the window 18. Therefore, in the vehicle application, the handle faces into the passenger compartment and is at least partially visible in the passenger compartment. Optionally, the arm 26 can include a grip 32 that can be grasped by the user. In certain embodiments, the grip 32 can be positioned closer to a distal end 34 of the arm 26 than the first pivot point 28. It is to be appreciated that the grip 32 can be in any suitable location to be grasped by the user.

Optionally, a lock apparatus can be utilized to secure the arm 26 in a particular position when desired. For example, the lock apparatus can be configured to prevent the arm 26 from moving to the second position to open the window 18. Therefore, if the vehicle 10 is left unattended, the window 18 can remain in the closed position due to the lock apparatus preventing the arm 26 from moving out of the first position when the window 18 is in the closed position.

The lock apparatus can be any suitable configuration and location. As one non-limiting example, the lock apparatus can include a hook that is selectively movable around the arm 26 to prevent rotation of the arm 26. As another non-limiting example, the lock apparatus can include a pin that is movable to selectively insert into a hole along the arm 26 to prevent rotation of the arm 26. The lock apparatus can include any suitable fasteners, clips, tabs, couplers, etc., and the arm 26 can include any suitable corresponding fasteners, clips, tabs, couplers, etc. to cooperate with the lock apparatus to secure the arm 26 in the particular position when desired. The lock apparatus can be motorized or manually implemented.

As best shown in FIG. 3, the arm 26 includes an extension 36 fixed thereto such that the arm 26 and the extension 36 both move concurrently about the first pivot point 28. Said differently, movement of the arm 26 also moves the extension 36 accordingly. In other words, the arm 26 and the extension 36 move simultaneously between the first and second positions. In certain embodiments, the arm 26 is rotatable about the first pivot point 28, and thus, the extension 36 is also rotatable about the first pivot point 28. Therefore, the arm 26 and the extension 36 move the same distance relative to the first pivot point 28.

The extension 36 and the arm 26 can be separate pieces fixed to each other, or the extension 36 and the arm 26 can be formed of one piece. If separate pieces, the extension 36 and the arm 26 can be fixed to each other by any suitable method(s), and non-limiting examples can include welding, adhesive, one or more fasteners, one or more pins, one or more studs, etc. If formed of one piece, the extension 36 and the arm 26 can be fixed to each other by any suitable method(s), and non-limiting examples can include extrusion, casting, stamping, etc.

Turning back to FIG. 2, the window assembly 12 further includes a connector 38 coupled to the extension 36 at a second pivot point 40. As best shown in FIG. 2, the arm 26 is coupled to the window 18 through the connector 38. As also best shown in FIG. 2, the first and second pivot points 28, 40 are spaced from each other. The connector 38 is coupled to the window 18 such that movement of the arm 26 moves the connector 38 about the second pivot point 40 which causes the window 18 to move between the closed and open positions. Additionally, the connector 38 can overlap part of the extension 36 when the arm 26 is in the first position. In certain embodiments, the connector 38 can overlap part of the extension 36 and the arm 26 when the arm 26 is in the first position.

Referring to FIG. 1, the window assembly 12 can also include a bracket 42 secured to the window 18. Generally, the bracket 42 can support the window 18. As such, the bracket 42 moves with the window 18 linearly relative to the frame 14. The bracket 42 can be any suitable configuration, and the FIGS. are one non-limiting example. For example, in FIG. 2, the bracket 42 can define a slot 44 and the window 18 can be disposed in the slot 44. As such, part of the window 18 is cradled by the bracket 42. The bracket 42 will be discussed further below.

Continuing with FIG. 1, the window 18 can include a first edge portion 46 and a second edge portion 48 opposing each other. The first and second edge portions 46, 48 are spaced from each other, and the side edges 24 are disposed between the first and second edge portions 46, 48. Said differently, the first and second edge portions 46, 48 and the side edges 24 cooperate to define an outer periphery of the window 18.

Generally, the second edge portion 48 can be disposed further from the bracket 42 than the first edge portion 46. In certain embodiments, the bracket 42 is secured to the window 18 along the first edge portion 46. Furthermore, a part of the first edge portion 46 can be disposed in the slot 44 of the bracket 42.

Referring to FIG. 2, the connector 38 can be attached to the bracket 42 at a third pivot point 50 such that the connector 38 is coupled to the window 18 through the bracket 42. Therefore, movement of the arm 26 causes the connector 38 to move, and movement of the connector 38 causes the bracket 42 and the window 18 to move linearly relative to the frame 14. Generally, the third pivot point 50 is spaced from the first and second pivot points 28, 40. The connector 38 is movable relative to both the second and third pivot points 40, 50 when the arm 26 moves between the first and second positions (compare the solid lines and the phantom lines in FIG. 2). Furthermore, the second and third pivot points 40, 50 both change positions relative to the first pivot point 28 as the arm 26 moves between the first and second positions. The connector 38 is rotatable about both the second and third pivot points 40, 50 when the arm 26 moves between the first and second positions such that the connector 38 changes orientation relative to the first pivot point 28.

Turning to FIGS. 1 and 2, the window 18 can define a first plane 52 that intersects the first pivot point 28. Furthermore, the first plane 52 can intersect the connector 38 when the arm 26 is in the first position. At least a portion of the first edge portion 46 of the window 18 and the entire second edge portion 48 of the window 18 are spaced from the first plane 52 on opposite sides of the first plane 52. In other embodiments, the entire first edge portion 46 of the window 18 is spaced from the first plane 52.

The extension 36 extends from the arm 26 at an angular orientation that positions the second pivot point 40 over-center of the first pivot point 28. This over-center position also positions at least part of the connector 38 over-center of the first pivot point 28. Therefore, when the arm 26 is in the first position such that the window 18 is in the closed position, the over-center position of the second pivot point 40 prevents the arm 26 from moving to the second position under the weight of the window 18 until a force is applied by the user to move the arm 26 to the second position. Therefore, the position of the connector 38 relative to the extension 36 when in the first position provides a self-locking feature. As such, the self-locking feature prevents the window 18 from moving to the open position under the weight of the window 18.

Referring to FIG. 2, the extension 36 can project from the arm 26 at an angle 54 to position the second pivot point 40 over-center of the first pivot point 28 which is utilized to maintain the window 18 in the closed position. Generally, the extension 36 can project from the arm 26 at the angle 54 of about 1 degree to about 89 degrees relative to the first pivot point 28. In certain embodiments, the angle 54 is about 65 degrees to about 85 degrees. More specifically, in certain embodiments, the angle 54 is about 70 degrees to about 80 degrees. In yet other embodiments, the angle 54 is about 40 degrees to about 50 degrees.

Therefore, depending on the angle 54 that the extension 36 projects, the location of the second and third pivot points 40, 50 can be different than illustrated during movement of the arm 26 between the first and second positions, and thus the location of these pivot points 40, 50 relative to the first plane 52 can be different than illustrated.

Additionally, the arm 26 has a first length 56, the extension 36 has a second length 58 and the connector 38 has a third length 60. The first length 56 can be greater than the second and third lengths 58, 60. Furthermore, the third length 60 can be greater than the second length 58. It is to be appreciated that the arm 26, the extension 36 and the connector 38 can be any suitable lengths, and the FIGS. are non-limiting examples. For example, one or more of the lengths 56, 58, 60 can be changed in order to change the amount of force to move the arm 26 between the first and second positions and/or change the self-locking feature and/or change the amount that the window 18 moves linearly.

Non-limiting examples of the different locations of the second and third pivot points 40, 50 relative to the first plane 52, which can be due to the angle 54 of the extension 36 and/or the length 56 of the arm 26, the length 58 of the extension 36 and/or the length 60 of the connector 38, are discussed below.

In certain embodiments, the second and third pivot points 40, 50 can be spaced from each other on the opposite sides of the first plane 52 when the arm 26 is in the first position. Furthermore, in these embodiments, the second and third pivot points 40, 50 can be spaced from each other on the opposite sides of the first plane 52 when the arm 26 is in the second position. As one non-limiting example, FIG. 2 illustrates the second and third pivot points 40, 50 on the opposite sides of the first plane 52 when in the first position and the second position.

In other embodiments, the second and third pivot points 40, 50 can be spaced from each other on the opposite sides of the first plane 52 when the arm 26 is in the first position. In these embodiments, the second and third pivot points 40, 50 can be spaced from each other on a same side of the first plane 52 when the arm 26 is in the second position.

In yet other embodiments, the second and third pivot points 40, 50 can be spaced from each other on the same side of the first plane 52 when the arm 26 is in the first position. In these embodiments, the second and third pivot points 40, 50 can be spaced from each other on the same side of the first plane 52 when the arm 26 is in the second position.

In yet other embodiments, the second and third pivot points 40, 50 can be spaced from each other on the same side of the first plane 52 when the arm 26 is in the first position. Furthermore, in these embodiments, the second and third pivot points 40, 50 can be spaced from each other on the opposite sides of the first plane 52 when the arm 26 is in the second position.

Turning to FIGS. 1 and 2, the window 18 can also define a second plane 62 disposed perpendicular to the first plane 52. Therefore, the second plane 62 can intersect the first pivot point 28. The second plane 62 can also intersect the first and second edge portions 46, 48. Furthermore, in certain embodiments, the second plane 62 can intersect the connector 38 when the arm 26 is in the second position (see FIG. 2). The side edges 24 of the window 18 are spaced from the second plane 62 on opposite sides of the second plane 62.

Depending on the angle 54 that the extension 36 projects, the location of the second and third pivot points 40, 50 can be different than illustrated during movement of the arm 26 between the first and second positions, and thus the location of these pivot points 40, 50 relative to the second plane 62 can be different than illustrated. Non-limiting examples of different locations of the second and third pivot points 40, 50 relative to the second plane 62, which can be due to the angle 54 of the extension 36 and/or the length 56 of the arm 26, the length 58 of the extension 36 and/or the length 60 of the connector 38, are discussed below.

In certain embodiments, the second and third pivot points 40, 50 are spaced from each other on a same side of the second plane 62 when the arm 26 is in the first position. Furthermore, in these embodiments, the second and third pivot points 40, 50 can be spaced from each other on the opposite sides of the second plane 62 when the arm 26 is in the second position. As one non-limiting example, FIG. 2 illustrates the second and third pivot points 40, 50 on the same side of the second plane 62 when the arm 26 is in the first position, and the second and third pivot points 40, 50 on the opposite sides of the second plane 62 when the arm 26 is in the second position.

In other embodiments, the second and third pivot points 40, 50 can be spaced from each other on the opposite sides of the second plane 62 when the arm 26 is in the first position. In these embodiments, the second and third pivot points 40, 50 can be spaced from each other on the opposite sides of the second plane 62 when the arm 26 is in the second position.

In yet other embodiments, the second and third pivot points 40, 50 can be spaced from each other on the same side of the second plane 62 when the arm 26 is in the first position. In these embodiments, the second and third pivot points 40, 50 can be spaced from each other on the same side of the second plane 62 when the arm 26 is in the second position.

In yet other embodiments, the second and third pivot points 40, 50 can be spaced from each other on the opposite sides of the second plane 62 when the arm 26 is in the first position. Furthermore, in these embodiments, the second and third pivot points 40, 50 can be spaced from each other on the same side of the second plane 62 when the arm 26 is in the second position.

The window assembly 12 can also include a first fastener 64 disposed through the first pivot point 28 to connect together the arm 26 and the brace 30, a second fastener 66 disposed through the second pivot point 40 to connect together the extension 36 and the connector 38, and a third fastener 68 disposed through the third pivot point 50 to connect together the connector 38 and the bracket 42. The first, second and third fasteners 64, 66, 68 can be any suitable configuration to allow the bracket 42, the arm 26, the extension 36 and the connector 38 to move as discussed above. Non-limiting examples of the first, second and third fasteners 64, 66, 68 can include one or more of: bolts, pins, screws, sleeves, etc.

The window assembly 12 described herein provides a manual way to open and close a vent window 18. Therefore, the window assembly 12 eliminates the need for a wiring harness, an electrical window regulator and one or more switches for the electrical window regulator, which can reduce costs and provide mass savings.

While the best modes and other embodiments for carrying out the disclosure have been described in detail, those familiar with the art to which this disclosure relates will recognize various alternative designs and embodiments for practicing the disclosure within the scope of the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

What is claimed is:

1. A window assembly comprising:

a window movable between a closed position and an open position;

an arm movable between a first position and a second position, with the window disposed in the closed position when the arm is in the first position, and with the window disposed in the open position when the arm is in the second position;

wherein the arm includes an extension fixed thereto such that the arm and the extension both move together concurrently about a first pivot point;

a connector coupled to the extension at a second pivot point, and the connector includes a third pivot point spaced from the second pivot point, with the arm coupled to the window through the connector, and wherein the first and second pivot points are spaced from each other;

wherein:

the connector is coupled to the window such that movement of the arm moves the connector about the second pivot point which causes the window to move between the closed and open positions;

the window defines a first plane that intersects the first pivot point;

the second and third pivot points are disposed on opposite sides of the first plane when the arm is in the first position;

the third pivot point remains on the same side of the first plane when the arm is in the first and second positions; and the first pivot point remains in a fixed position as the arm moves between the first and second positions.

2. The assembly as set forth in claim 1:

further including a bracket secured to the window;

wherein the connector is attached to the bracket at the third pivot point such that the connector is coupled to the window through the bracket;

wherein the third pivot point is spaced from the first pivot point; and wherein the connector is movable relative to both the second and third pivot points when the arm moves between the first and second positions.

3. The assembly as set forth in claim 2 wherein the second and third pivot points both change positions relative to the first pivot point as the arm moves between the first and second positions.

4. The assembly as set forth in claim 2 wherein the connector is rotatable about both the second and third pivot points when the arm moves between the first and second positions such that the connector changes orientation relative to the first pivot point.

5. The assembly as set forth in claim 2 wherein:

the window includes a first edge portion and a second edge portion opposing each other, with the second edge portion disposed further from the bracket than the first edge portion; and the bracket is secured to the window along the first edge portion.

6. The assembly as set forth in claim 5 wherein at least a portion of the first edge portion of the window and the entire second edge portion of the window are spaced from the first plane on opposite sides of the first plane.

7. The assembly as set forth in claim 6 wherein the second and third pivot points are spaced from each other on the opposite sides of the first plane when the arm is in the second position.

8. The assembly as set forth in claim 6 wherein the first plane intersects the connector when the arm is in the first position.

9. The assembly as set forth in claim 6 wherein:

the window defines a second plane disposed perpendicular to the first plane;

the second plane intersects the first and second edge portions; and the second and third pivot points are spaced from each other on opposite sides of the second plane when the arm is in the first position.

10. The assembly as set forth in claim 2 wherein the window is movable linearly between the closed and open positions.

11. The assembly as set forth in claim 1 wherein the arm has a first length, the extension has a second length and the connector has a third length, and wherein the first length is greater than the second and third lengths, and wherein the third length is greater than the second length.

12. The assembly as set forth in claim 1 wherein the connector overlaps part of the extension when the arm is in the first position.

13. The assembly as set forth in claim 1 wherein the extension projects from the arm at an angle of about 1 degree to about 89 degrees relative to the first pivot point.

14. The assembly as set forth in claim 1 wherein the arm is a handle.

15. The assembly as set forth in claim 1:

further including a bracket secured to the window and supports the window;

wherein the connector is attached to the bracket at the third pivot point such that the connector is coupled to the window through the bracket;

wherein the third pivot point is spaced from the first pivot point;

wherein the second and third pivot points both change positions relative to the first pivot point as the arm moves between the first and second positions;

wherein the connector is rotatable about both the second and third pivot points when the arm moves between the first and second positions such that the connector changes orientation relative to the first pivot point;

wherein the window includes a first edge portion and a second edge portion opposing each other, with the second edge portion disposed further from the bracket than the first edge portion;

wherein the bracket is secured to the window along the first edge portion;

wherein at least a portion of the first edge portion of the window and the entire second edge portion of the window are spaced from the first plane on opposite sides of the first plane;

wherein the first plane intersects the connector when the arm is in the first position;

wherein the window defines a second plane disposed perpendicular to the first plane;

wherein the second plane intersects the first and second edge portions; and wherein the second and third pivot points are spaced from each other on opposite sides of the second plane when the arm is in the first position.

16. A vehicle comprising:

a frame defining an aperture;

a window supported by the frame, and the window is movable linearly relative to the frame between a closed position covering the aperture and an open position partially uncovering the aperture;

an arm supported by the frame at a first pivot point;

wherein the arm is movable relative to the frame between a first position and a second position, with the window disposed in the closed position when the arm is in the first position, and with the window disposed in the open position when the arm is in the second position;

wherein the arm includes an extension fixed thereto such that the arm and the extension both move together concurrently about the first pivot point;

a connector coupled to the extension at a second pivot point, and the connector includes a third pivot point spaced from the second pivot point, with the arm coupled to the window through the connector;

wherein:

the first and second pivot points are spaced from each other;

the connector is coupled to the window such that movement of the arm moves the connector about the second pivot point which causes the window to move between the closed and open positions;

the window defines a first plane that intersects the first pivot point;

the second and third pivot points are disposed on opposite sides of the first plane when the arm is in the first position; and the third pivot point remains on the same side of the first plane when the arm is in the first and second positions.

17. The vehicle as set forth in claim 16:

further including a bracket secured to the window;

wherein the connector is attached to the bracket at the third pivot point such that the connector is coupled to the window through the bracket;

wherein the third pivot point is spaced from the first pivot point; and wherein the connector is movable relative to both the second and third pivot points when the arm moves between the first and second positions.

18. The vehicle as set forth in claim 17 wherein:

the first pivot point remains in a fixed position as the arm moves between the first and second positions; and the second and third pivot points both change positions relative to the first pivot point as the arm moves between the first and second positions.

19. The vehicle as set forth in claim 16 wherein the extension projects from the arm at an angle of about 1 degree to about 89 degrees relative to the first pivot point.

20. A window assembly comprising:

a window movable between a closed position and an open position;

an arm movable between a first position and a second position, with the window disposed in the closed position when the arm is in the first position, and with the window disposed in the open position when the arm is in the second position;

wherein the arm includes an extension fixed thereto such that the arm and the extension both move concurrently about a first pivot point;

a connector coupled to the extension at a second pivot point, with the arm coupled to the window through the connector, and wherein the first and second pivot points are spaced from each other;

wherein the connector is coupled to the window such that movement of the arm moves the connector about the second pivot point which causes the window to move between the closed and open positions;

further including a bracket secured to the window;

wherein the connector is attached to the bracket at a third pivot point such that the connector is coupled to the window through the bracket;

wherein the third pivot point is spaced from the first and second pivot points;

wherein the connector is movable relative to both the second and third pivot points when the arm moves between the first and second positions;

the window includes a first edge portion and a second edge portion opposing each other, with the second edge portion disposed further from the bracket than the first edge portion;

the bracket is secured to the window along the first edge portion;

the window defines a first plane that intersects the first pivot point;

at least a portion of the first edge portion of the window and the entire second edge portion of the window are spaced from the first plane on opposite sides of the first plane; and the second and third pivot points are spaced from each other on the opposite sides of the first plane when the arm is in the first position.

* * * * *